United States Patent [19]

Duret

[11] Patent Number: 5,027,765

[45] Date of Patent: Jul. 2, 1991

[54] METHOD OF PNEUMATIC INJECTION OF FUEL INTO A CYLINDER OF A RECIPROCATING INTERNAL COMBUSTION ENGINE AND A CORRESPONDING INJECTION DEVICE

[75] Inventor: Pierre Duret, Paris, France

[73] Assignee: Institut Francais du Petrole, Rueil Malmaison, France

[21] Appl. No.: 292,530

[22] Filed: Dec. 30, 1988

[30] Foreign Application Priority Data

Dec. 30, 1987 [FR] France ..... 87 18359

[51] Int. Cl.[5] ..... F02M 67/04

[52] U.S. Cl. ..... 123/316; 123/532; 123/534

[58] Field of Search ..... 123/316, 26, 532, 534

[56] References Cited

U.S. PATENT DOCUMENTS

| | | | |
|---|---|---|---|
| 4,033,302 | 7/1977 | Jarnuszkiewicz | 123/534 |
| 4,191,135 | 3/1980 | Nohira et al. | 123/316 |
| 4,192,265 | 3/1980 | Amano et al. | 123/316 |
| 4,210,105 | 7/1980 | Nohira et al. | 123/316 |
| 4,406,260 | 9/1983 | Burley | 123/316 |
| 4,628,888 | 12/1986 | Duret | 123/534 |
| 4,716,877 | 1/1988 | Duret | 123/532 |

FOREIGN PATENT DOCUMENTS

| | | | |
|---|---|---|---|
| 2714090 | 10/1978 | Fed. Rep. of Germany | 123/26 |

*Primary Examiner*—Tony M. Argenbright
*Assistant Examiner*—Robert E. Mates
*Attorney, Agent, or Firm*—Antonelli, Terry, Stout & Kraus

[57] ABSTRACT

Scavenging a cylinder of an engine with fuel-free fresh air and injection with atomized liquid fuel by a pressurized gas are accomplished independently, at specific moments during by the operating cycle of the engine. The fuel is atomized and injected into the cylinder by gases tapped from cylinder of the engine. The injection device can comprise a reservoir in which the gases tapped from cylinder are stored. The gases can be tapped from cylinder by a pneumatic injector when the valve opens.

8 Claims, 2 Drawing Sheets

METHOD OF PNEUMATIC INJECTION OF FUEL INTO A CYLINDER OF A RECIPROCATING INTERNAL COMBUSTION ENGINE AND A CORRESPONDING INJECTION DEVICE

FIELD OF THE INVENTION

The invention relates to a method of pneumatic fuel injection into a cylinder of a reciprocating internal combustion engine and a corresponding pneumatic injection device.

BACKGROUND OF THE INVENTION

In highly efficient two-cycle engines with one or more cylinders, attempts have been made to provide independent scavenging of the cylinder(s) by fuel-free fresh air and introduction of atomized liquid fuel into the cylinder(s), these two operations being performed at successive points in time precisely determined by the engine operating cycle.

The atomized fuel can be introduced into the cylinder by a pneumatic injection device comprising an injector terminating in the cylinder and equipped with a valve, controlled by a cam which opens and closes the valve, a means for supplying the injector with liquid fuel, and a source of compressed air to atomize and inject the fuel when the injector opens.

The cylinder is scavenged by fresh air from a pump housing having lower part communicating with the cylinder, so that the piston, as it moves in the cylinder, compresses the air in the housing as it approaches bottom dead center. Two pipes connecting the pump housing to the intake ports of the cylinder transfer the compressed air to the cylinder, with the compressed air entering the cylinder being scavenged when the intake ports are uncovered by the piston as it approaches bottom dead center.

It has been proposed that fuel be injected pneumatically by using the compressed air from the pump housing to atomize and inject the fuel. For this purpose, the pump housing can be connected to the injector by a pipe containing a check valve. The part of the pipe located downstream of the check valve can itself constitute a compressed air reservoir or can be connected to such a reservoir. When the injector opens, a certain quantity of compressed air is used to atomize the fuel and inject it into the cylinder. The compressed air reservoir is recharged by opening the valve when the pressure is close to maximum in the pump housing.

A device of the aforementioned type eliminates the supplementary compressed gas source, however, requires a connecting pipe between the pump housing and the injector and possibly a reservoir communicating with said connecting pipe.

In multicylinder fuel-injected engines, it has been proposed to use hot pressurized gases tapped from a cylinder to atomize the fuel in another cylinder of the engine. Injection occurs at the cylinder intake valve through which the fuel-air mixture is added to fill the cylinder. The effect of the hot tapped gases is limited to ensuring the atomization and possibly the vaporization of the liquid fuel introduced into the cylinder when the intake valve opens, by mixing with the incoming air and being drawn into the cylinder.

In this case, in contrast to the case of two-cycle engines and the like, fresh scavenging air is not introduced into the cylinder independently of the fuel, and the fuel itself is not introduced under pressure by a pneumatic injector independent of the device for introducing air into the cylinder.

Heretofore, pneumatic injection has always employed either an auxiliary compressed air supply or a connecting pipe between the pump housing and the cylinder and possibly a reservoir for storing the compressed air.

SUMMARY OF THE INVENTION

The aim of the invention is therefore to propose a method of injecting fuel pneumatically into a cylinder of a reciprocating internal combustion engine comprising a cylinder with independent scavenging by fuel-free fresh air and injection of atomized liquid fuel by a pressurized gas, at specific times in the engine operating cycle, thereby eliminating the need for an auxiliary compressed air supply and means for connecting the pump housing with the injector if the engine has a pump housing.

For this purpose, the fuel is atomized and injected into the cylinder by gases tapped from one cylinder of the engine.

The invention likewise relates to a device for injecting fuel pneumatically into one cylinder of an engine by using gases tapped from said cylinder or from another cylinder of the engine, in the case of a multicylinder engine.

The injection device according to the present invention may be characterized by a valve being controlled by a cam with a shape and arrangement such as to open the valve twice per cycle, namely, once before compression to inject the fuel and the second time during expansion to refill the reservoir with pressurized gas.

The method and injection device according to the invention will now be described as a non-limitative example, with reference to the attached drawings, showing several versions and using injection devices according to several embodiments.

DETAILED DESCRIPTION

Figure 1:
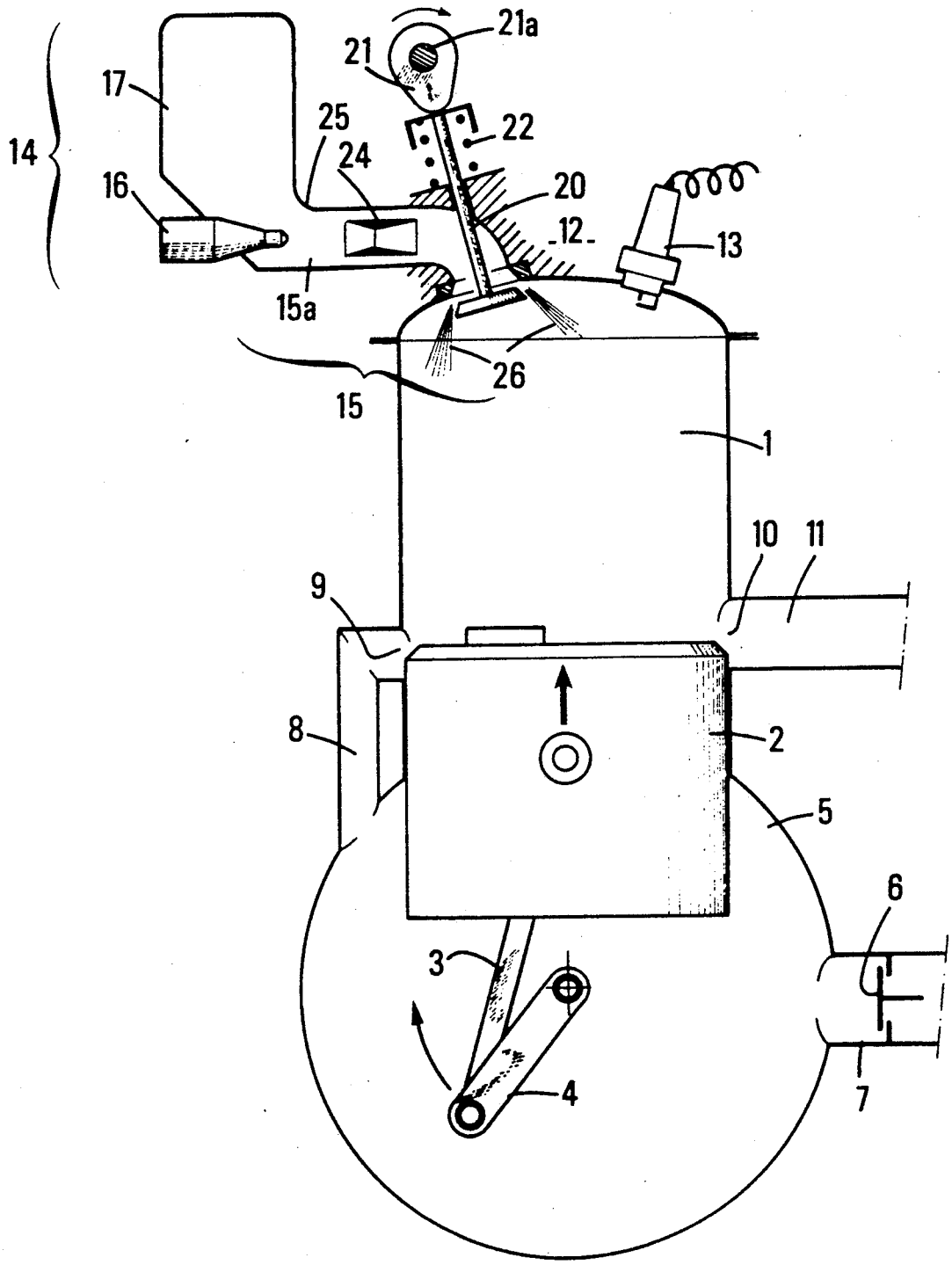
FIG. 1 is a schematic elevation and cross section of two-cycle engine comprising a pneumatic injection device according to a first embodiment of the invention.

FIG. 1 shows a cylinder 1 of a two-cycle engine comprising a reciprocating piston 2 connected by a connecting rod 3 to a crankshaft, with the cylinder 1 communicating by an open lower part thereof with a pump housing 5 partially penetratable by the piston 2 as the piston 2 approaches a bottom dead center as shown in FIG. 1. Housing 5 has an air inlet pipe 7 opened and closed by a check valve 6. As the piston 2 approaches bottom dead center, the piston 2 compresses the air in pump housing 5, forcing the compressed air into pipes 8 which terminate at transfer ports 9 in the chamber of cylinder 1. Scavenging of cylinder 1 by fresh air is thus accomplished by pump housing 5 and pipes 8 when piston 2 uncovers ports 9 as it descends.

An outlet pipe 11 communicates with the chamber of cylinder 1 by outlet ports 10 whose positions, as viewed in the direction of travel of piston 2, are offset slightly relative to the positions of transfer ports 9 so that as piston 2 descends, the piston 2 first uncovers exhaust ports 10 and then the transfer ports 9 for scavenging cylinder 1 with fresh air, while the burned gases are exhausted through ports 10.

Cylinder 1 is sealed at its upper end by a cylinder head 12 in which a spark plug 13 is mounted together with an assembly 14 comprising a pneumatic injection device 15 and a reservoir 17.

Pneumatic injector 15 for supplying liquid fuel comprises a chamber 15*a* provided inside cylinder head 12 and opening into the upper part of cylinder 1 at the level of seat 18 of a valve and a valve 20 whose stem contacts at its end an actuating cam 21, with the valve 20 cooperating with the seat 18 to open or close the pneumatic injector 15 by the cam 21 and a return spring 22.

Fuel injector 16 supplies fuel to chamber 15*a* which may be provided with a venturi 24. Reservoir 17 communicates with the chamber of injector chamber 15*a* by pipe 25. A portion of the pipe 25 can comprise a part of chamber 15*a* itself and can comprise the fuel injector 16 and the venturi 24.

As the piston 2 descends, the piston 2 successively uncovers exhaust openings 10 and transfer openings 9 before arriving at bottom dead center as explained above. The cylinder is then scavenged by fresh air as piston 2 reaches bottom dead center, then ascends as shown in FIG. 1.

When the crankshaft has rotated through an angle alpha of, for example, between 10 and 50 degrees after bottom dead center and preferably between 20 degrees and 30 degrees, the cam 21 opens pneumatic injector 15 by pushing down the stem of valve 20 as shown in FIG. 1. The position of cam 21 on its shaft 21*a* can be adjusted to open the valve 20 for an angle alpha of a selected value, i.e. with piston 2 in a certain position. Thus, the valve 20 may be controlled by the cam 21 having a shape and arrangement so as to open the valve 20 twice per cycle, once before compression to inject the fuel and a second time during expansion to refuel the fuel reservoir 17 with pressurized gas.

Gas contained in reservoir 17 whose internal pressure is significantly greater than the pressure inside the cylinder at the moment selected for injection enters pneumatic injection chamber 15 at very high speed after passing through venturi 24.

Chamber 15*a* of injector 15 is filled in advance with liquid fuel by fuel injector 16, so that this liquid fuel is very finely atomized by the gas at very high speed and injected into cylinder 1 at the level of seat 18 in the form of jets 26 composed of gas containing very fine droplets of fuel in suspension and possibly mixed with vaporized fuel if reservoir 17 contains hot gases.

The atomized fuel-gas mixture mixes with the fresh air filling cylinder 1, whereupon the resultant fuel-air mixture is compressed by piston 2 as the piston 2 ascends in cylinder 1, covering ports 9 and 10.

The shape of cam 21 is designed to keep valve 20 open as compression begins. The pressure of the fuel-air mixture in the cylinder increases above the pressure in reservoir 17. The air or the fuel-air mixture, depending on how injection is controlled and on the stratification of the fresh air and fuel-air mixture in cylinder 1, enters reservoir 17, refilling it with pressurized gas.

When a fuel-air mixture is sent into reservoir 17 to refill it, this fuel-air mixture obviously contains a much smaller proportion of fuel than the proportion of fuel contained in the injected mixture.

The shape and position of cam 21 allow valve 20 to close under the influence of spring 22 at a specific moment during compression of the mixture in cylinder 1, so that the pressure of the gas in reservoir 17, in equilibrium with the chamber of cylinder 1, makes efficient atomization and injection of the fuel into the cylinder possible during the following cycle.

Cam 21 can be shaped so that the valve 20 closes between 100 degrees and 130 degrees after bottom dead center.

The operating cycle of the engine proceeds normally, with the fuel-air mixture igniting and burning when the piston is at top dead center. Piston 2 then descends in the cylinder, with the burned gases escaping and scavenging with fresh air occurring once more as described above. A new injection of fuel using the gas under pressure in reservoir 17 which was recharged during the previous cycle then takes place at A.

The disadvantage of the operating mode described above is that reservoir 17 is refilled with gas containing fuel, so that engine efficiency decreases slightly by comparison to operation using a compressed air supply not recharged by the engine cylinder.

A cam 21 can be shaped so that the valve opens twice for each revolution of the crankshaft.

Cam 21 is made such that valve 20 opens for the first time slightly after the cylinder has reached bottom dead center, so that pneumatic injection occurs as described above, thanks to the pressurized gas contained in reservoir 17. Cam 21, which has a complex shape, also causes valve 20 to open a second time during the expansion phase or even during the exhaust phase of the burned gases filling cylinder 1 at a time when the pressure in the cylinder is greater than the pressure in reservoir 17. Reservoir 17 is thus refilled by gases which are mostly burned gases or which contain a small residual amount of unburned fuel.

Cam 21 allows valve 20 to close for a first time after injection at the beginning of the compression stage in the cylinder, before the pressure of the fuel-air mixture is sufficient for this air to enter reservoir 17. Valve 20 then remains closed throughout compression, combustion, and the start of expansion. As stated above, valve 20 then opens during expansion or at the start of the exhaust phase, for a time and amount less than during the first opening. The pressure differential between the chamber of cylinder 1 and reservoir 17 is much higher than during the first opening for injection of the fuel-air mixture. Reservoir 17 is thus pressurized very rapidly by the gases in the chamber of cylinder 1.

According to a particular design of the device shown in FIG. 1, injector 16 can be used to produce discontinuous injection such that the injector does not inject fuel while the reservoir is being refilled.

This permits better control of the transitional modes of the engine, by reducing the concentration of fuel retained in the reservoir. A simply way of obtaining such a function is not to allow injector 16 to function unless the valve 20 is closed.

Figure 2:
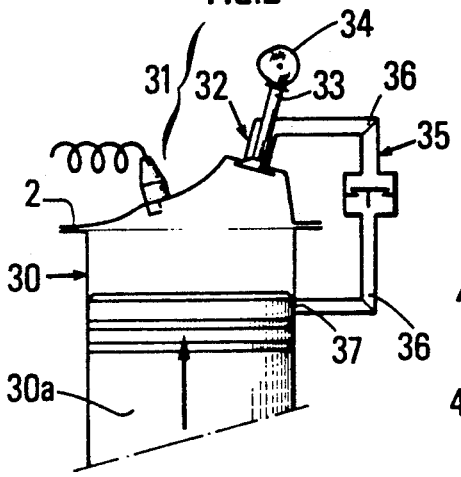
FIG. 2 is a partial elevation and cross section of a cylinder of an engine comprising a pneumatic injection device according to a second embodiment of the invention.
Figure 3:
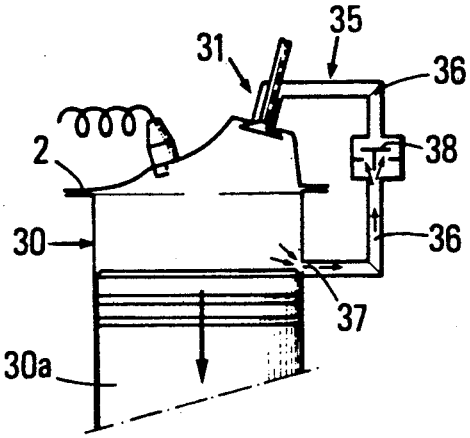
FIG. 3 is a view similar to FIG. 2 showing the cylinder of the engine at a different moment in the operating cycle.

As shown in FIGS. 2 and 3, the upper part of a cylinder 30 of a two-cycle engine comprises an injection device 31 whose upper part has a shape different from that of device 14 shown in FIG. 1.

Pneumatic injector 32 terminating in the upper part of cylinder 30 comprises as above a valve 33 operated by a cam 34, a means for supplying liquid fuel (not shown), and a device 35 furnishing pneumatic injector 32 with pressurized gas to atomize and inject the liquid fuel.

Device 35 comprises a pipe 36 communicating at one end with the chamber of cylinder 30 by a port 37 located above the discharge and transfer ports of the cylinder (not shown) and at its other end with the chamber of pneumatic injector 32 at the upper part of the cylinder. A check valve 38 is located in pipe 36 and divides this pipe into an upstream part communicating with cylinder 30 and a downstream part communicating with injector 32. Check valve 38 opens when the pressure differential between the upstream and downstream parts of pipe 36 exceeds a certain value corresponding to the tare of valve 38.

The downstream part of pipe 36 can itself constitute a pressurized gas reservoir communicating with the chamber of valve 32. This downstream part of pipe 36 can also be made to communicate with a reservoir allowing gas to be stored under pressure.

In FIG. 2 piston 30*a* ascends inside cylinder 30 and compresses a fuel-air mixture located in the upper part of the cylinder. Piston 30*a* covers port 37 while valve 38, subjected to slightly different upstream and downstream pressures, remains closed.

Figure 4:
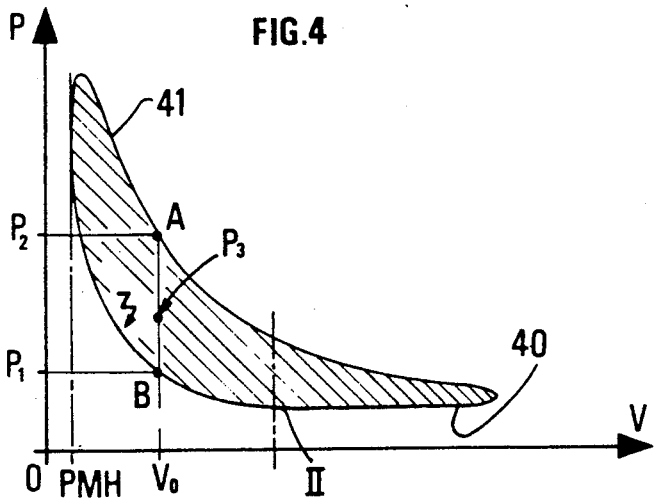
FIG. 4 is an operating diagram of the engine shown in FIGS. 2 and 3.

In FIG. 4, the shaded area represents the operating cycle of the engine in a diagram plotting the pressure of the gases contained in the cylinder as a function of the volume occupied by these gases. The operating point of the engine describes curve 40 delimiting the cycle at its lower part when the piston ascends and upper limiting curve 41 of the cycle when piston 30*a* descends.

At the end of compression, piston 30*a* reaches top dead center, and volume V is minimal. Ignition followed by combustion occurs during compression. The pressure in the cylinder reaches its maximum soon afterward and the piston descends.

When the upper part of piston 30*a* reaches the level of port 37 (FIG. 3) the volume of the gas in the cylinder has a value V0 and the pressure of this gas has a value of P2. The operating point of the engine corresponds to point A in FIG. 4. Check valve 38 lifts and the gases contained in the chamber of cylinder 30 fill pipe 35 and possibly a reservoir for storing gas under pressure downstream from valve 38. Thus, as described more fully hereinbelow, the downstream part of the pipe 35 is at a pressure less than P2 when ports 37 open.

Piston 30*a* continues descending and uncovers the discharge ports. The pressure falls in the cylinder chamber during the phases of exhaust and scavenging by fresh air. Check valve 38 closes again very rapidly when the pressure falls below P2. Closure of valve 38 forms a gas supply at a pressure essentially equal to P2.

After passing through bottom dead center, piston 30*a* ascends again in the cylinder, with the operating point in FIG. 4 describing the curve 40.

Before compression starts, cam 34 opens valve 33 of injector 32 (operating point I). Liquid fuel is atomized and injected into the upper part of cylinder 30 by gas at pressure P2 stored in pipe 35 and/or the reservoir downstream from valve 38. The pneumatic injector can be designed to close quite rapidly, with the time being determined during design or adjustment of the engine as a function of cam 34, with the pressure downstream from valve 38 assuming a value below P2.

The fuel-air mixture contained in the cylinder is then compressed by piston 30*a*. The upper part of piston 30*a* covers opening 37 at the start of compression (point B in FIG. 4). The residual volume in the cylinder is V0 and the gas pressure is P1. Pressure P1, as indicated by the graph in FIG. 4, is markedly lower than pressure P2. The pressure in pipe 35 upstream from valve 38 then assumes a value P1 less than P2. This position of piston 30*a* is shown in FIG. 2.

The injection conditions are such that the pressure downstream from the valve 38 assumes a valve P3 between P2 and P1. Otherwise, if pipe 36 is sufficiently empty during injection to reach a pressure less than P1, valve 38 will open during compression to allow pipe 36 to reach a pressure close to P1 when the ascending piston covers port 37. The remainder of the process is identical in both cases.

Thus, valve 38 remains closed until the operating point returns to A (configuration in FIG. 3). Piston 30*a* uncovers port 37, so that the upstream part of pipe 35 is at a pressure P2 greater than P3. Valve 38 opens and the downstream part of pipe 35 comprising the injection gas reservoir is recharged with burned gases at pressure P2.

Figure 5:
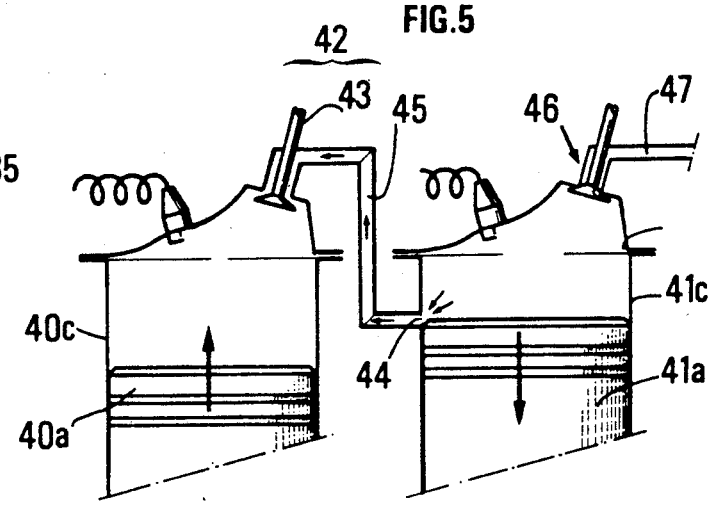
FIG. 5 is a schematic elevation and cross section through two cylinders of a multicylinder engine comprising an injection device according to a third embodiment of the invention.

In, FIG. 5 the upper parts of two cylinders 40C and 41C of a two-cycle multicylinder engine are shown. A pneumatic injection device 42 is associated with cylinder 40C and comprises a pneumatic injector whose chamber terminates in the upper part of cylinder 40C at the level of a seat with which injector valve 43 is associated. Injection device 42 also comprises a means for feeding the pneumatic injector with liquid fuel (not shown) and a pipe 45 joining the upper part of the chamber of cylinder 41C to the chamber of pneumatic injector 42 of cylinder 40C.

The two cylinders 40C and 41C are designed so that their operating cycles are offset in such manner that at the end of scavenging and before compression in cylinder 40C, at the moment when pneumatic injection of the fuel is about to be triggered by the opening of valve 43, piston 41*a* of cylinder 41 uncovers port 44 during the expansion phase, causing pipe 45 to communicate with the combustion chamber of cylinder 41C. The gases in cylinder 41C are then at a pressure very much higher than the pressure of the gases in cylinder 40C, so that when valve 43 opens, the fuel is atomized and injected into cylinder 40C by the pressurized gas from the chamber of cylinder 41C.

FIG. 5 shows the configuration of cylinders 40C and 41C just before the injection of the fuel into cylinder 40C, at the moment when port 44 of cylinder 41C is uncovered by piston 41*a* as it descends.

Cylinder 41C comprises a fuel-injection device 46 similar to device 42 of cylinder 40C, whose pipe 47 for admitting gas under pressure is connected to a cylinder of the engine with its operating cycle offset relative to that of cylinder 41C analogously to the offset between cylinders 40C and 41C.

Figure 6:
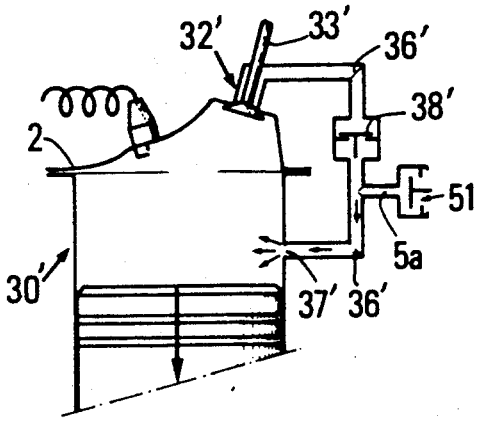
FIG. 6 is a schematic cross section and elevation of a cylinder of an engine comprising an injection device according to a fourth embodiment of the invention.

FIG. 6 shows an embodiment of injection device 32 as shown in FIGS. 2 and 3. The corresponding elements in FIGS. 2 and 3 and FIG. 6 have the same reference numbers plus the prime (') for the elements of the device shown in FIG. 6.

Injection device 32' comprises a pipe 36' analogous to pipe 36 in the device shown in FIGS. 2 and 3, communicating at one end with the interior chamber of cylinder 30' by a port 37' and at the other end with the injector chamber that communicates by valve 33' with the upper part of cylinder 30'. A valve 38' is installed in pipe 36', dividing pipe 36' into an upstream part communicating with port 37' of cylinder 30' and a downstream part communicating with the pneumatic injector.

Upstream from valve 38' pipe 36' is connected by a pipe 50 and a valve 51 to a source of fresh air which can be atmospheric air, with valve 51 having a fresh air inlet.

During the gas exhaust phase and the scavenging of cylinder 30' of the two-cycle engine, the chamber of this cylinder 30' can be depressurized by the effects of the exhaust wave. This depression causes valve 51 to open and also causes scavenging of the upstream part of pipe 36' in cylinder 30 by the fresh air.

The method and device according to the invention in all cases offer the advantage of using gases under pressure available in the engine itself to atomize and inject fuel. This pressurized gas can also be tapped near the area where it is to be used to inject the fuel into the cylinder. The gas pressures can also be very high relative to the pressure in the cylinder at the moment of injection, which also improves the quality of fuel atomization and injection. It is also possible to keep engine power losses down by using mainly burned gases for injection.

The invention is not limited to the embodiments described hereinabove, and for example, it is possible to use injectors different shapes, with gas storage capacities for pressurized gases in the various arrangements relative to the injector and to the cylinders and injector control cams of different shapes.

The invention applies not only to two-cycle engines but also to any reciprocating internal-combustion engine in which introduction of and scavenging with fresh air and pneumatic fuel injection are performed independently.

The scope of the present invention includes the use instead of valve 20, 33, 43, 46 or 33', of an automatic valve that functions as a check valve, a rotating plug valve, or a solenoid valve.

I claim:

1. Method of pneumatic fuel injection into a cylinder of a reciprocating internal combustion engine comprising at least one cylinder, the method comprising the steps of independently scavenging the at least one cylinder with fuel-free fresh air and injecting liquid fuel atomized by a pressurized gas at predetermined times during a single operating cycle of the engine by tapping gases from the at least one cylinder of the engine, wherein said tapping includes opening a valve means controlling a communication between a pressure storage reservoir for the pressurized gas and the at least one cylinder at a first time during the single operating cycle for injecting fuel into the at least one cylinder prior to a compression and opening the valve means at a second time during the single operating cycle at an expansion thereof to refill the pressure reservoir storage with the pressurized gas.

2. Method according to claim 1, wherein the injecting is a pneumatic injection.

3. Method according to claim 2, wherein the tapping of gas from the at least one cylinder is effected through an opening of the at least one cylinder into which the fuel is injected.

4. A pneumatic injection device for injecting fuel into a cylinder of a reciprocating internal combustion engine comprising at least one cylinder, means for supplying the at least one cylinder with fuel-free air for scavenging, the pneumatic fuel injection device comprising a pneumatic injector including a chamber terminating in the at least one cylinder, means for supplying the pneumatic injector with liquid fuel, and means for supplying the pneumatic injector with pressurized gas to atomize and inject the fuel in finely divided form into the at least one cylinder, including valve means for supplying the at least one cylinder with the gases contained in the at least one cylinder, and means controlling said valve means so as to be opened twice during a cycle of the engine, a first time prior to compression to inject the fuel and a second time during expansion to provide a pressurized gas storage.

5. Device according to claim 4, wherein said means for supplying the pneumatic injector with pressurized gas includes a storage reservoir forming said pressurized gas storage connected to the chamber of the at least one cylinder, and wherein the chamber of the pneumatic injector terminates in an upper part of the at least one cylinder at a level of a seat means of said valve means.

6. Device according to claim 5, wherein said means for controlling includes cam means for opening said valve means twice per cycle.

7. Device according to one of claims 4, 5 or 6, wherein the pneumatic injector further includes a discontinuously operating fuel injector.

8. Device according to claim 7, wherein said fuel injector is operable only when said valve means is closed.

* * * * *